US006655112B1

(12) United States Patent
Cremer et al.

(10) Patent No.: US 6,655,112 B1
(45) Date of Patent: Dec. 2, 2003

(54) PRIMARY PACKAGING UNIT FOR FILM-LIKE OR OBLATE-LIKE ADMINISTERED SHAPES

(75) Inventors: Karsten Cremer, Bonn (DE); Karin Ludwig, Datzeroth (DE); Dieter Anhäuser, Melsbach (DE); Klaus Schumann, Neuwied (DE); Peter Steinborn, Neuwied (DE); Uwe Bungarten, Neuwied (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 09/582,889

(22) PCT Filed: Jan. 5, 1999

(86) PCT No.: PCT/EP99/00020

§ 371 (c)(1),
(2), (4) Date: Sep. 12, 2000

(87) PCT Pub. No.: WO99/35051

PCT Pub. Date: Jul. 15, 1999

(30) Foreign Application Priority Data

Jan. 10, 1998 (DE) ..... 198 00 682

(51) Int. Cl.[7] ..... B65B 9/00

(52) U.S. Cl. ..... 53/450; 53/553; 53/435; 53/520; 156/247; 156/249; 156/301

(58) Field of Search ..... 53/450, 553, 435, 53/520; 156/247, 249, 289, 299, 300, 301

(56) References Cited

U.S. PATENT DOCUMENTS

| | | | | | |
|---|---|---|---|---|---|
| 2,836,291 | A | * | 5/1958 | Stroop | 53/449 |
| 3,007,848 | A | | 11/1961 | Stroop | 167/83 |
| 3,145,112 | A | | 8/1964 | Boegershausen | 99/171 |
| 3,596,428 | A | * | 8/1971 | Young | 53/28 |
| 3,978,637 | A | * | 9/1976 | Mauriello | 53/450 |
| 4,009,239 | A | * | 2/1977 | Bowen | 264/112 |
| 4,307,555 | A | * | 12/1981 | Mlodozeniec et al. | 53/53 |
| 4,349,531 | A | * | 9/1982 | Mlodozeniec | 424/27 |
| 4,789,415 | A | * | 12/1988 | Faasse, Jr. | 156/519 |
| 4,841,712 | A | * | 6/1989 | Roou | 156/248 |
| 5,052,166 | A | * | 10/1991 | Ziegler et al. | 53/433 |
| 5,185,983 | A | * | 2/1993 | Slater | 156/483 |
| 5,648,136 | A | * | 7/1997 | Bird | 428/76 |
| 5,740,661 | A | * | 4/1998 | Yamaguchi et al. | 53/513 |
| 5,806,284 | A | * | 9/1998 | Gifford | 53/435 |
| 5,935,613 | A | * | 8/1999 | Benham et al. | 264/316 |
| 6,253,920 | B1 | | 7/2001 | Kaellgren | |
| 6,350,339 | B1 | * | 2/2002 | Sessions | 156/250 |

FOREIGN PATENT DOCUMENTS

| | | |
|---|---|---|
| DE | 2432925 C3 | 7/1974 |
| DE | 2746414 A1 | 10/1977 |
| DE | 79 31 081 U | 4/1980 |
| EP | 0 219 762 A | 4/1987 |
| HU | P9801823 | 11/1998 |

* cited by examiner

*Primary Examiner*—Stephen F. Gerrity
*Assistant Examiner*—Louis Tran
(74) *Attorney, Agent, or Firm*—Jordan and Hamburg LLP

(57) ABSTRACT

A primary packaging unit for film-like or wafer-like administration forms for oral application with an off-cut of an upper web of packaging material and of an lower web of packaging material is characterized in that a plurality of dosage units of a film-like or wafer-like administration form, individually sealed in flat compartments formed without cold or hot forming of the packaging material and spaced at a distance to one another, are present in a primary packaging unit, and there are perforations between the compartments which enable the separation of individual compartments, if necessary.

9 Claims, 3 Drawing Sheets

PRIMARY PACKAGING UNIT FOR FILM-LIKE OR OBLATE-LIKE ADMINISTERED SHAPES

BACKGROUND OF THE INVENTION

The present invention relates to a primary packaging unit for film-like or wafer-like administration forms for oral application. The invention especially relates to a primary packaging unit which is formed out of the film-like or wafer-like administration form to be packaged, as well as an off-cut of an upper and a lower web of packaging material, respectively.

Film-like or wafer-like administration forms for oral application are known, for example, from the patents or applications U.S. Pat. No. 3,007,848, DE 24 32 925, DE 27 46 414 and EP 219 762. Such administration forms differ from conventional solid application forms, such as tablets or capsules, especially in their geometrical form and their production. They all have a thin, flat-shaped form, whereby differences with regard to flexibility, brittleness, smoothness or consistency can lead to either film- or sheet-like, paper-like, or wafer-like characteristics. For the production of said administration forms, the extrusion and coating processes applied in industrial film production were especially recommended.

Depending on the purpose of application, two basic types of embodiment suggest themselves. The first type comprises variations with rapid disintegration or rapid release for disintegration in the oral cavity immediately upon application under release of an active substance, whereby the term "rapid disintegration" in the sense of this invention relates to a disintegration time of several seconds up to a maximum of several minutes under influence of saliva. The other type comprises variations which disintegrate slowly or practically not at all, and are especially suited for slow and continuous active substance release and which, through addition of mucoadhesive materials, are able to adhere to the oral mucosa during the release of active substance. Both of these basic types can be embodied so that, depending on the incorporated active substance, they are suited for a local therapy of the oral mucosa or the systematic application of active substances.

The packaging of these administration forms in primary packaging units cannot simply be carried out with the usual processes, packaging means or machines commonly used for conventional pharmaceutical products such as capsules or tablets. A primary packaging unit for solid administration forms in individual doses, embodied from a modern point of view, should on the one hand protect the product from outer influences and on the other hand enable the deliberate and controllable removal of a single dosage unit at the desired time of intake, whereby the removal of the dosage unit from the primary packaging unit should be carried out in such a way that the administration form is not damaged.

Whereas tablets and capsules are often filled into glasses or boxes in larger amounts, which certainly would not suffice to fulfil the above requirements, it is in many cases customary to package dosage units in blister packages or deep-drawn packages. Such primary packaging units contain a plurality of dosage units which are each individually sealed in a cavity between two off-cuts of packaging material webs. The cavity is created through hot or cold forming of the lower web of packaging material with the help of an adequate tool before filling. After the cavities are filled, the upper web of packaging material is supplied and sealed together with the lower web of packaging material.

In modern blister packages, the dosage units are removed by exerting a pressure, with a finger, on the outer side of the deformed areas of the lower packaging material web and thus on the tablet or capsule contained in the cavity created through deformation, whereby the exerted pressure is sufficient to break through the upper web of packaging material and press out the dosage unit. This is, however, only possible if the material of the upper packaging material web does not exceed a certain strength.

This concept for primary packaging units has become widely known and used for conventional administration forms. For administration forms with film-like or wafer-like embodiments, however, it presents considerable disadvantages. In experiments carried out to this effect, two disadvantages have proved to be particularly serious, one of which concerns the production, and the other of which concerns the removal of dosage units from primary packaging units of this kind.

Film-like or wafer-like oral administration forms, especially the rapid release kinds, are generally very much lighter and less compact than conventional tablets or capsules. The recommended dimensions of film-like or wafer-like dosage units are approximately from 1 $cm^2$ (e.g. DE 27 46 414) to 3 $cm^2$ or more (e.g. DE 24 32 925), with a thickness of approximately 0.05 to 1 mm (e.g. DE 24 32 925). Using common pharmaceutical base materials, this then results in dosage units with a mass of approximately 5 to 100 mg, whereby the typical and preferred embodiments would tend to lie in the lower margin of this span. It has turned out, however, that enclosing such thin films or wafers in blisters is quite problematic. Especially in the case of higher machine speeds, air movement caused by moving machine parts and often also electrostatic charging of the packaging materials lead to the result that the dosage units cannot be correctly positioned in the blister or are wafted back out of the blister after being positioned therein. Although it is quite possible to produce deep-drawn primary packaging units with oral films or wafers, this is a complicated and inefficient packaging concept due to the problems mentioned above. The removal of film-like or wafer-like administration forms from blister packages which correspond to the conventional primary packaging for tablets and capsules is also problematic. A flat-shaped dosage unit lying in a cavity can hardly be pressed through the material of the upper web of packaging material; it has neither the necessary format nor the mechanical strength. The danger of damaging the dosage unit while pressing it out of the package is relatively large. Even if one first tries to break the material of the upper packaging material web in another way, e.g. using a fingernail, it is not easy to grip and remove a flat dosage unit in the exposed cavity, except when very large cavities are chosen, which is disadvantageous because of other reasons such as the enclosed air space, which is too large in relation the small mass of the administration form.

The use of conventional packaging means results in additional difficulties if the film-like or wafer-like administration forms are rather brittle and fragile. In this case, a dimensionally stable blister package can offer a certain amount of product protection during storage, but it makes the removal of the dosage units even more difficult.

In addition to these disadvantages of conventional blister packages for film-like or wafer-like administration form, the choice of adequate packaging materials for blister packages is limited; also, the available materials do not belong to the especially cheap packaging materials.

Several approaches for the creation of a primary packaging unit for film-like or wafer-like administration forms without the above described disadvantages of the state of the art are found in U.S. Pat. No. 3,007,848. The solutions presented in this document are partially of interest for all film-like and wafer-like administration forms although in U.S. Pat. No. 3,007,848, in contrast to the present invention, in the narrower sense refers to (1) wafers produced through extrusion or through printing of edible films, whereby (2) said wafers are not intended for application in the oral cavity, but rather for swallowing, and (3) are for this purpose optionally first sealed into film strips of an edible, smooth and easily swallowable film. The cited document does, however, teach the packaging of wafers by sealing the dosage units between two films which can in a general sense be understood as packaging materials. In addition, it teaches the only "light" sealing of the dosage units to enable an easier opening of the compartments and removal of the wafers. Finally, it also teaches an unsealed outer area of the packaging material which facilitates the gripping of the packaging material films and their pulling apart to remove the wafers.

U.S. Pat. No. 3,007,848, which constitutes a state-of-the-art solution near to the present invention, does not, however, fulfil all requirements for an adequate primary packaging unit for film-like or wafer-like administration forms. Several disadvantages and problems remain unsolved or newly arise through the embodiment of the packaging unit suggested therein.

On the one hand, the packaging units suggested therein contain only one wafer each, disregarding the intermediary product, which comprises an undefined but very large amount of packaged dosage units as a sort of tape goods that can be rolled up. A practicable primary packaging unit should, however, for various reasons generally contain a clearly defined amount of dosage units. If this requirement is not fulfilled, clear disadvantages arise for the secondary packaging. First, the small primary packaging units separated according to U.S. Pat. No. 3,007,848 must be filled with one wafer each, collected, counted to package sizes of e.g. 20 units and gathered together, which costs a considerable effort and leads to unwieldy secondary packaging formats. For each later extraction, a primary packaging unit would have to be removed, opened, and the wafer extracted, whereby a control of the intake up to a certain point in time is very difficult. In the case of a secondary packaging unit with 50 wafers, for example, it will hardly be possible, without an arduous counting of the remaining wafers, to keep track of whether a certain due dose has already been taken or not.

It is thus the object of the present invention to provide a primary packaging unit for film-like or wafer-like administration forms which fulfils all of the above mentioned requirements without having the above described disadvantages of the state of the art.

SUMMARY OF THE INVENTION

This object is achieved by providing a primary packaging unit for film-like or wafer-like administration forms for oral application with an off-cut of an upper and a lower web of packaging material, respectively. Said packaging unit is characterized in that a plurality of dosage units of a film-like or wafer-like administration form, individually sealed in flat compartments formed without cold or hot forming of the packaging material and spaced at a distance to one another, are present in a primary packaging unit, and in that there are perforations between the compartment which enable the separation of individual compartments, if necessary.

This combination of characteristics is necessary to achieve the claimed, practicable primary packaging unit. A simple variation of the concept of U.S. Pat. No. 3,007,848 to the effect that the intermediate product, which is present, for example, as rolled stock or tape goods, is cut, not after each wafer, as claimed, but rather after, for example, every tenth wafer, does not suffice to achieve the object stated above. A thus produced packaging unit would contain a defined amount of dosage units; these could, however, not be extracted easily and without problems. Experiments have shown that when opening such a package for the extraction of one dosage unit, the sealed seams or sealed areas around several dosage units adjacent to this unit are generally opened simultaneously, so that several dosage units are exposed and no longer protected by the primary packaging. As described above, the targeted removal of a single dosage unit by pressing it through the primary packaging unit is not possible either because of the low mechanical strength of the administration form in relation to the primary packaging material.

It was found that a primary packaging unit which satisfactorily fulfils the objects of the invention must also have an additional characteristic: a perforation between the compartments in which the individual dosage units are situated, whereby said perforation must be such that it is possible, for the extraction of a single dosage unit, to first separate the compartment containing this dosage unit from the primary packaging unit, if necessary, so that the compartment can then be opened without damaging further compartments. The perforation further offers the advantage that in a respective embodiment with ideally only a few small holding points, it also enables the targeted opening of a compartment without first detaching it from the primary packaging unit, without simultaneously opening further compartments.

A further advantage of the primary packaging unit according to the invention is the relatively small head space of the compartments in which the dosage units are situated. Oxidation- or moisture-sensitive products can thus largely be protected against the harmful influences of atmospheric oxygen and air humidity if the primary packaging materials are chosen accordingly.

A further advantage of the primary packaging unit according to the invention is the small amount of required packaging material and the compact, space-saving format. A folding box with a height of 1 cm, for example, can easily hold ten or more primary packaging units with ten dosage units each.

A further advantage of the primary packaging unit according to the invention is the possibility of using, for the lower web of packaging material, materials which are considerably thinner and cheaper than those which are suitable for the production of blister packages and for cold and hot forming and which must have a certain minimum thickness and thus also a minimum weight.

A further advantage of the primary packaging unit according to the invention is the possibility of visually presenting therapy patterns on the package by means of printing. Thus, a packaging unit can e.g. be embodied as a 7-day-package with seven dosage units of a drug which is to be taken once a day, whereby the individual compartments of the packaging unit are printed with the names or abbreviations of the different days of the week. With the help of this therapy pattern printed onto the package, patients can very easily control their intakes. In a preferred embodiment, the subject matter of the invention contains printing.

Because film-like or wafer-like administration forms, as described, for example, in DE 24 32 925, are especially advantageously first produced as a cast film from which the dosage units can be obtained by cutting or punching, a further preferred embodiment of the primary packaging unit according to the invention contains dosage units which are off-cuts or punched-out pieces of cast films. Cast films in the sense of this invention include all film-like compositions produced by casting of carrier materials or coating of the same with polymer-containing solutions, suspensions or emulsions, and subsequent drying.

A further preferred embodiment of the primary packaging unit according to the invention contains sealed seams or sealed areas between the off-cuts of the upper and lower webs of packaging materials which are peelable. The term peelable in the sense of this invention comprises all sealed seams and sealed areas which can be separated with a moderate pulling force, e.g. less than approx. 10 N/15 mm, whereby the packaging material web off-cuts generally remain intact. For the production of such peelable sealing seams, special sealing materials, for example those referred to as "peel-PE", a special polyethylene that generally contains a further polymer such as e.g. polystyrene, and special sealing conditions (pressure, time, temperature) are used. It is, however, also possible to seal conventional sealing materials under such conditions that the result is not a composite in the form of a melted sealed seam but rather a peelable seam.

A further preferred embodiment of the primary packaging unit according to the invention provides that next to each compartment, outside of the sealed areas or sealed seams, there is an unsealed edge on at least one side. This unsealed edge serves as a gripping tab for an easy gripping of the off-cuts of the upper and lower webs of packaging material and separation of the packaging materials to open a compartment. In a further preferred embodiment, these gripping tabs or unsealed edges have different respective lengths for the off-cuts of the upper and lower webs of packaging material. If one of these two packaging material web off-cuts protrudes at the edge, it is especially easy to grip and bend away from of the second packaging material web off-cut, due to which this second off-cut can also be gripped more easily.

Packaging material webs for the production of primary packaging units according to the invention can be single-layered. Generally, however, they will be multi-layered to be able to meet the requirements that must be posed to modern packaging materials and in connection with film-like or wafer-like administration forms.

Common often-used layers are, for example, kraft paper for providing rigidity, plastic films for providing tensile strength and tightness of the packaging material, sealing lacquers for a better sealing capacity, protective lacquers for impregnation of the kraft paper, aluminum for an especially high tightness, glue for the cohesion of individual layers, etc. In terms of economic considerations, optimized packaging material laminates do not have more layers or greater layer thicknesses than necessary for the respective object.

In certain cases, it will be necessary to employ a certain packaging material laminate for both the upper and the lower web of packaging material for a primary packaging unit according to the invention. If, for example, an especially high impermeability to gas is necessary which can only be achieved by means of an aluminum barrier layer, it will be necessary to use this element in both packaging material webs.

In other cases, however, different requirements can be posed to the upper web and the lower web. If, for example, a primary package is to have a certain minimum rigidity, for better handling, a preferred embodiment of the primary packaging unit according to the invention employs a web of packaging material with a bending rigidity of at least x in the case of a combined minimum strength of y $\mu$m, it is sufficient if this rigidity is mainly provided by one of the packaging material webs, while the other web of packaging material can be optimized under consideration of other economic or technical factors.

A further preferred variation of the primary packaging unit according to the invention with two differently embodied webs of packaging material contains a transparent upper packaging material web off-cut through which the dosage units of the administration form can be seen through the intact package. The definition of upper and lower web is arbitrary; if one transparent and one non-transparent web of packaging material is used, the transparent web is herewith defined as upper web in the sense of this invention. One of the advantages of this variation is the easy visual controllability of the compartments or the dosage units and their condition. A further advantage is that through a transparent upper web, printing on the upper surface of the lower web or also on the dosage units can be discerned. As such printing offers advantages, for example, with regard to intake control, as described above, a preferred embodiment of the primary packaging unit according to the invention contains a transparent upper packaging material web off-cut and either a lower web off-cut printed on its upper surface or dosage units printed on their upper side.

Packaging units according to the present invention are suited for all state-of-the-art film-like or wafer-like administration forms. These include simple, single-layered preparations which generally disintegrate rapidly in saliva, as well as multi-layered systems which adhere to the mucosa and release their active substance over a longer amount of time and the layers of which accordingly have different compositions, whereby at least one layer disintegrates only slowly or not at all in saliva and a further layer has mucoadhesive characteristics.

DETAILED DESCRIPTION OF THE INVENTION

Figure 1:
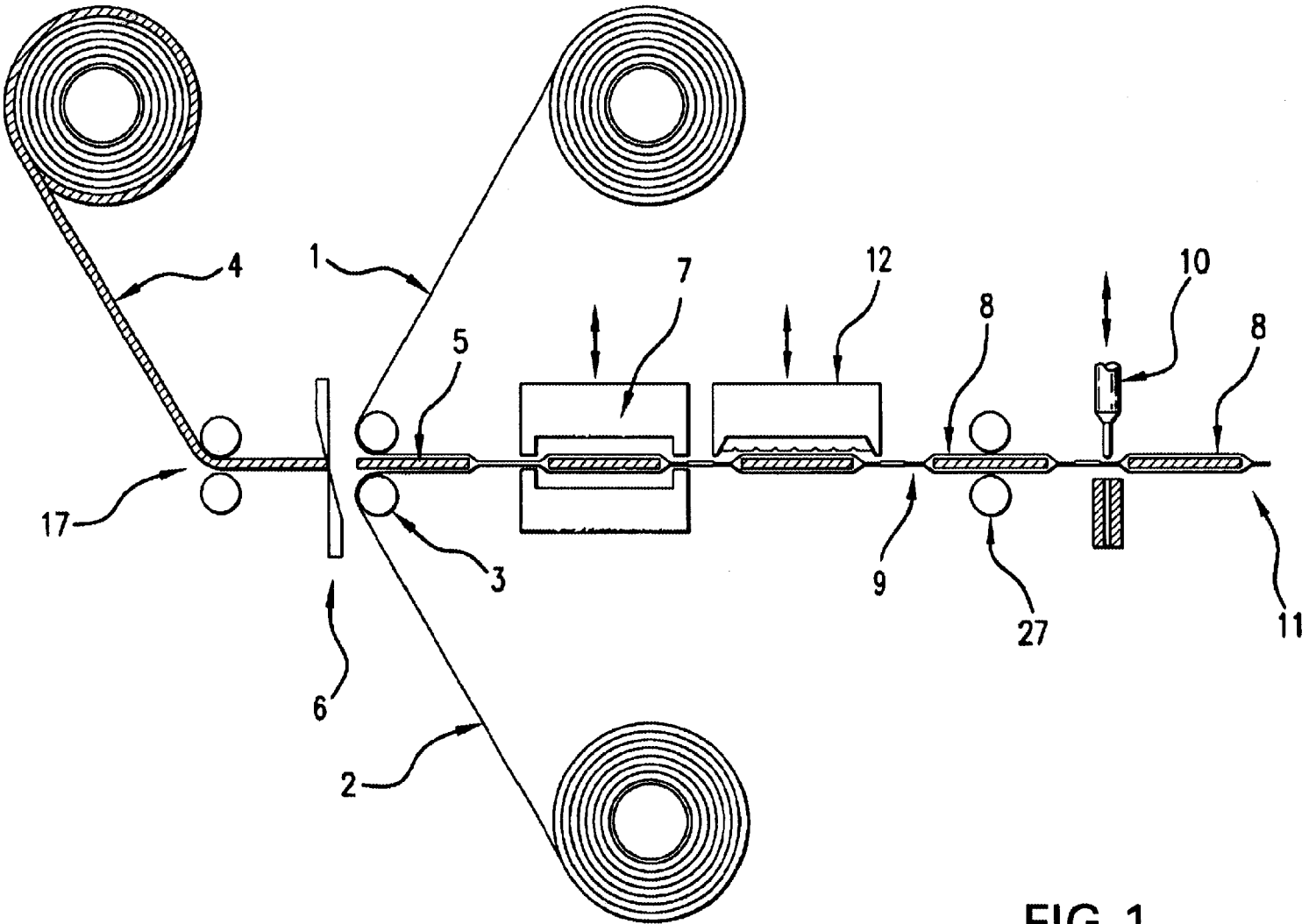
FIG. 1 is a schematic diagram of a preferred production process for packaging units with square or rectangular dosage units.

Primary packaging units according to the invention can be machine manufactured with surprising efficiency. A preferred production process, shown schematically in FIG. 1, for packaging units with square or rectangular dosage units 5 comprises at least the following fundamental process steps which can, if necessary, be supplemented by further steps for printing, additional forming of the packaging units, etc.: in a first step, an upper web of packaging material 1 and a lower web of packaging material 2 without cold or hot forming are conveyed on top of one another by means of respective comer pulleys 3, whereby the film-like or wafer-like administration form 4 is simultaneously conveyed between the two packaging material webs with the help of pulling devices 17 in the form of rolls or tongs. It is advantageous if the film-like or wafer-like administration form is already provided as a web material, single-webbed or multi-webbed, parallel and spaced at a distance to one another, with the desired width of the dosage units 5. It is also advantageous if the diameter of the comer pulleys is smaller than the length of the dosage units in the conveying direction of the webs. In a further process step, individual dosage units 5 are singled out of the web-formed administration form by means of a cross-cutting apparatus 6 which is positioned immediately in front of the comer pulleys. In a further process step, the two webs of packaging material are sealed together with the help of a heated sealing tool 7 in such a way that the single dosage units 5 are sealed into compartments 8 and are completely enclosed by sealed seams or sealed areas 9. In a further process step, perforations are punched between the compartments 8 by means of a punching device 12. In a further process step, primary packaging units 11 can be partitioned off by means of a second cross-cutting or punching device 10. The web of packaging units is conveyed with the help of pulling devices 27 in the form of rolls or tongs.

Figure 2:
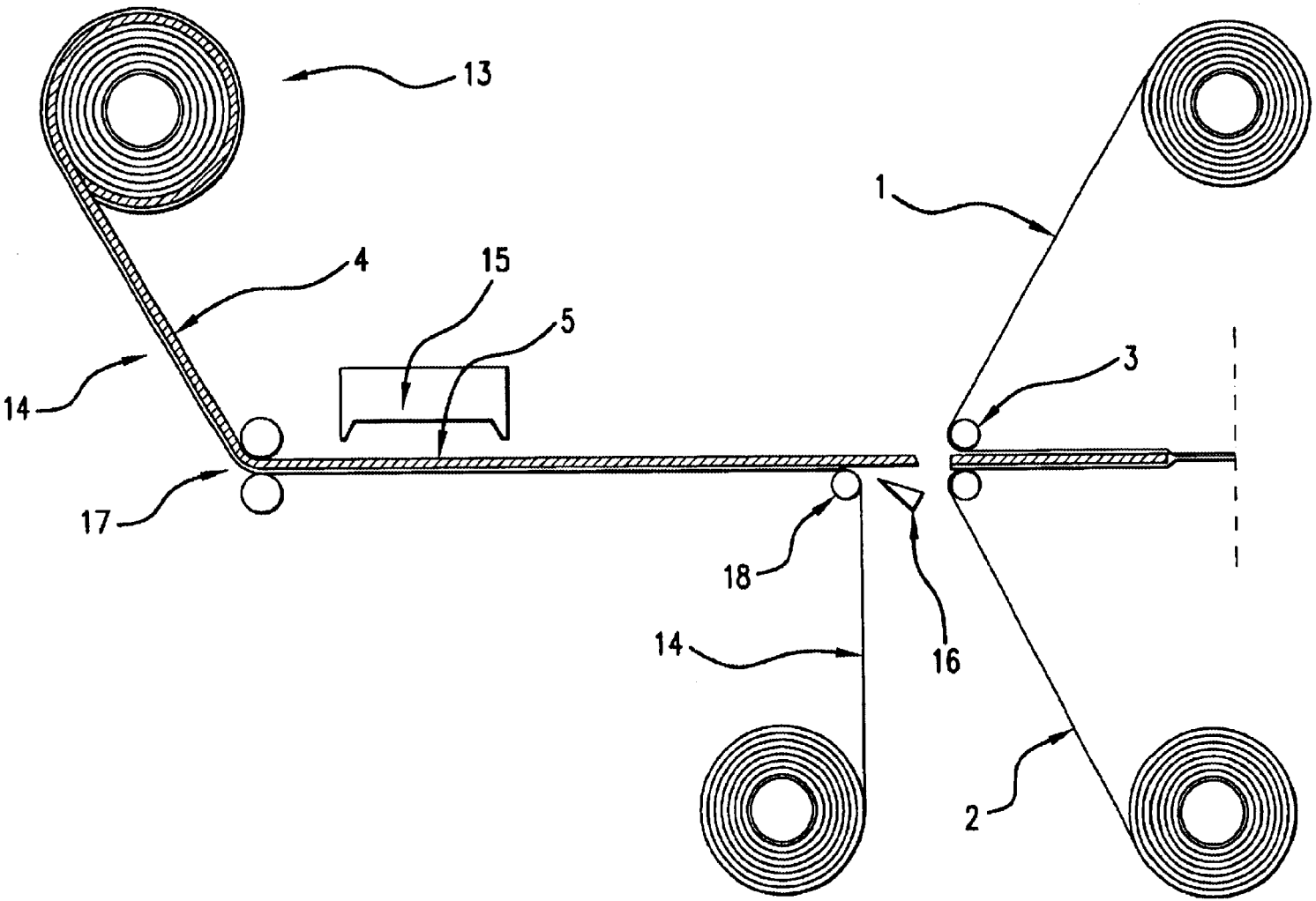
FIG. 2 is a schematic diagram another preferred multi-step production process in accordance with an embodiment of the invention.

Especially if dosage units 5 are desired which do not have a rectangular or square geometrical form, another multi-step production process is preferred which is schematically shown in FIG. 2. The process steps described here can also be supplemented by further steps or varied in their order if necessary. In one process step, the process comprises providing a laminate 13 of the web-formed, film-like or wafer-like administration form 4 and a carrier sheet 14, out of which the dosage units 5 are punched with a punching device 15 in a further process step, whereby the carrier sheet 14 is not punched through. In a further process step, the punched laminate 13 is rerouted over an edge or a corner pulley 18 with the help of pulling devices in the form of rolls or tongs 17 so that the dosage units 5 thereby become detached from the carrier sheet 14. If necessary, an additional stripping device 16 can be used for this. In a further process step, an upper web of packaging material 1 and a lower web of packaging material 2 without cold or hot forming are conveyed on top of one another by means of respective corner pulleys 3, whereby the dosage units 5 becoming detached from the carrier sheet 14 are simultaneously conveyed between the two webs of packaging material 1, 2. In a further process step, the two webs of packaging material are sealed together with the help of a heated sealing tool 7 according to FIG. 1 in such a way that the single dosage units 5 are sealed into compartments 8 and are completely enclosed by sealed seams or sealed areas 9. In a further process step, perforations are punched between the compartments 8 by means of a punching device 12. In a further process step, primary packaging units 11 can be partitioned off by means of a second cross-cutting or punching device 10.

Figure 3:
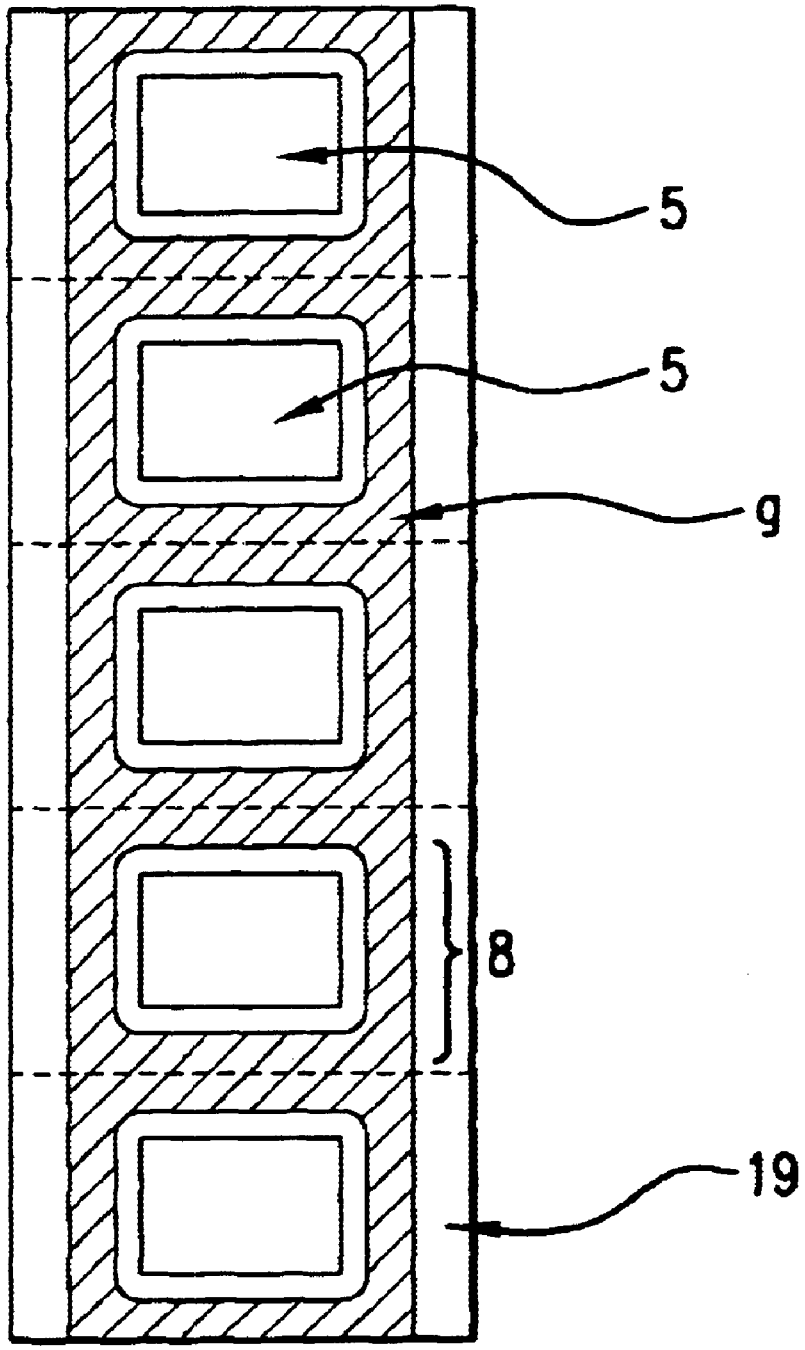
FIG. 3 is a schematic plan view of a primary packaging unit with rectangular dosing units produced in accordance with a production process in accordance with embodiment of the invention.

A preferred embodiment of the primary packaging unit according to the invention which is schematically shown in FIG. 3 provides compartments 8 that have an unsealed edge 19 on at least one side outside of the sealed seams or sealed areas 9.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Process for manufacturing a primary packaging unit for administration forms in a form of a film or wafer for oral application with a section of an upper web of packaging material and of a lower web of packaging material with a plurality of dosage units of an administration form being sealed in flat compartments and perforations being provided between the compartments comprising the steps of:

providing the administration form in a laminate comprising the administration form and a carrier sheet, said laminate being present as a web;

punching dosage units out of the administration form of said laminate while the carrier sheet is not punched through;

advancing the punched out laminate and diverting the carrier sheet in such a way that the dosage units become detached from the carrier sheet which includes a portion thereof backing said dosage units prior to detachment therefrom;

leading said dosage units between upper and lower packaging material webs;

sealing the upper and lower packaging material webs to each other in sections to form seals in such a way that compartments comprising dosage units are formed; and perforating said upper and lower packaging material between said compartments.

2. The process of claim 1 wherein in forming the dosage units, the laminate is drawn from a supply roll by means of pulling devices in the form of rolls or tongs, is punched and led around the edge of a deflecting roll.

3. The process of claim 1 wherein the upper and lower webs of packaging material are conveyed on top of one another by means of one deflecting roll per web while simultaneously the dosage units which are becoming detached from the carrier film are pushed between the two webs of packaging material.

4. The process of claim 1 further comprising severing individual primary packaging units by means of a cross-cutting device.

5. The process of claim 1 further comprising severing individual primary packaging units by means of a punching device.

6. A process according to claim 1, wherein said sealing forms peelable seals.

7. A process according to claim 6, wherein the pulling force for separating the upper web of packaging material from the lower web of packaging material is less than 10N/15mm.

8. A method of manufacturing a primary packaging unit containing individual dosage units of an administration form having a flattened configuration for oral application, the method comprising the steps of:

providing a laminate web comprising the administration form and a carrier sheet;

punching the laminate such that dosage units of desired shape are punched out of said administration form while the carrier sheet is not punched through;

providing upper and lower packaging material webs; re-routing the carrier sheet while advancing the laminate such that the individual dosage units become detached from the carrier sheet which includes a portion thereof backing said dosage prior to detachment therefrom;

leading said dosage units between the upper and lower packaging material webs; and sealing the upper and lower packaging material webs to each other to form bounded compartments each containing a one of said individual dosing units.

9. A method according to claim 8, further comprising perforating said upper and lower packaging material between said compartments.

* * * * *